US007374500B2

(12) United States Patent
Engdahl

(10) Patent No.: US 7,374,500 B2
(45) **Date of Patent: *May 20, 2008**

(54) PUTTER WITH FIXABLE SHAFT THAT ROTATES TO CONVERT THE PUTTER FROM PRACTICE TO PLAY

(76) Inventor: Duane Charles John Engdahl, 15801 N. 37th Dr., Phoenix, AZ (US) 85053

( * ) Notice: Subject to any disclaimer, the term of this patent is extended or adjusted under 35 U.S.C. 154(b) by 149 days.

This patent is subject to a terminal disclaimer.

(21) Appl. No.: 11/229,072

(22) Filed: Sep. 15, 2005

(65) Prior Publication Data

US 2006/0014591 A1 Jan. 19, 2006

Related U.S. Application Data

(63) Continuation-in-part of application No. 10/920,596, filed on Aug. 16, 2004, now Pat. No. 7,041,004, which is a continuation-in-part of application No. 10/351,495, filed on Jan. 23, 2003, now Pat. No. 6,776,727.

(51) Int. Cl.
*A63B 53/02* (2006.01)

(52) U.S. Cl. ..... 473/340; 473/342; 473/325; 473/328; 473/330; 473/295; 473/305; 473/313

(58) Field of Classification Search ..... 473/340, 473/342, 324, 325, 328, 330, 334–337, 295, 473/305–307, 313, 314; D21/736
See application file for complete search history.

(56) References Cited

U.S. PATENT DOCUMENTS 1,847,963 A 3/1932 Hix
D205,229 S 7/1966 Reed
3,399,898 A 9/1968 Burkland
3,430,963 A 3/1969 Wozniak
3,578,325 A 5/1971 Teas
3,637,218 A 1/1972 Carlino
3,700,244 A 10/1972 Liotta
3,901,514 A 8/1975 Priaulx
3,908,996 A 9/1975 Molinaro
4,523,758 A 6/1985 Guendling, Jr.
4,776,594 A 10/1988 Rango
4,805,922 A 2/1989 Whitfield
4,834,387 A * 5/1989 Waites et al. ..... 473/252
D325,949 S 5/1992 Harris, Jr.
D335,691 S 5/1993 Barker et al.
5,294,122 A * 3/1994 Longo ..... 473/328
5,362,056 A 11/1994 Minotti
5,383,664 A 1/1995 Epperson
5,415,399 A 5/1995 Kettelson (Continued)

*Primary Examiner*—Raleigh W. Chiu
(74) *Attorney, Agent, or Firm*—Etherton Law Group, LLC

(57) ABSTRACT

The present invention is an improved putter that assists a player in perfecting a putt stroke during practice and repeating it with the same club during play. The shaft is attached to the clubhead such that it can swivel from a practice configuration to a play configuration. The putter also comprises a hosel with an attached alignment cap has lobes which matingly engage a series of recesses on the clubhead to secure the clubhead to the shaft. The putter conforms to the Rules of Golf so that the player does not have to change clubs between practice and play. The club may be used for either a right or left-handed stroke.

20 Claims, 6 Drawing Sheets

U.S. PATENT DOCUMENTS

| | | | | |
|---|---|---|---|---|
| 5,433,441 | A | 7/1995 | Olsen | |
| 5,580,051 | A | 12/1996 | Fisher | |
| D381,384 | S | 7/1997 | Delio | |
| 5,863,257 | A | 1/1999 | Busnardo | |
| 6,203,443 | B1 * | 3/2001 | Britton | 473/244 |
| D458,979 | S | 6/2002 | Hill et al. | |
| 6,776,727 | B1 * | 8/2004 | Engdahl | 473/340 |
| 6,979,269 | B1 * | 12/2005 | Nohara | 473/244 |
| 7,040,999 | B2 * | 5/2006 | Trainello | 473/238 |
| 7,041,004 | B2 * | 5/2006 | Engdahl | 473/340 |
| 2003/0060301 | A1 * | 3/2003 | Hsu | 473/248 |
| 2004/0229712 | A1 * | 11/2004 | Jackson | 473/340 |
| 2005/0020373 | A1 * | 1/2005 | Engdahl | 473/251 |
| 2006/0014591 | A1 * | 1/2006 | Engdahl | 473/340 |

* cited by examiner

FIG. 6
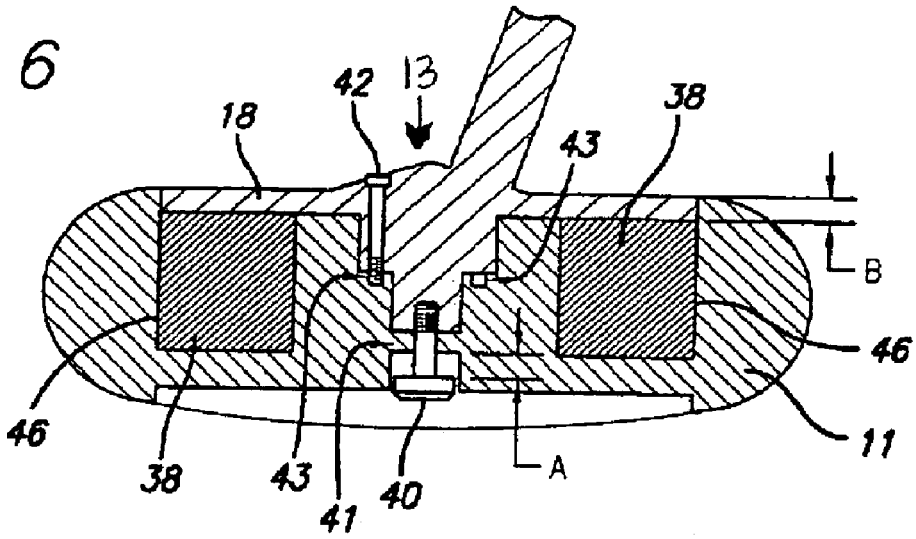
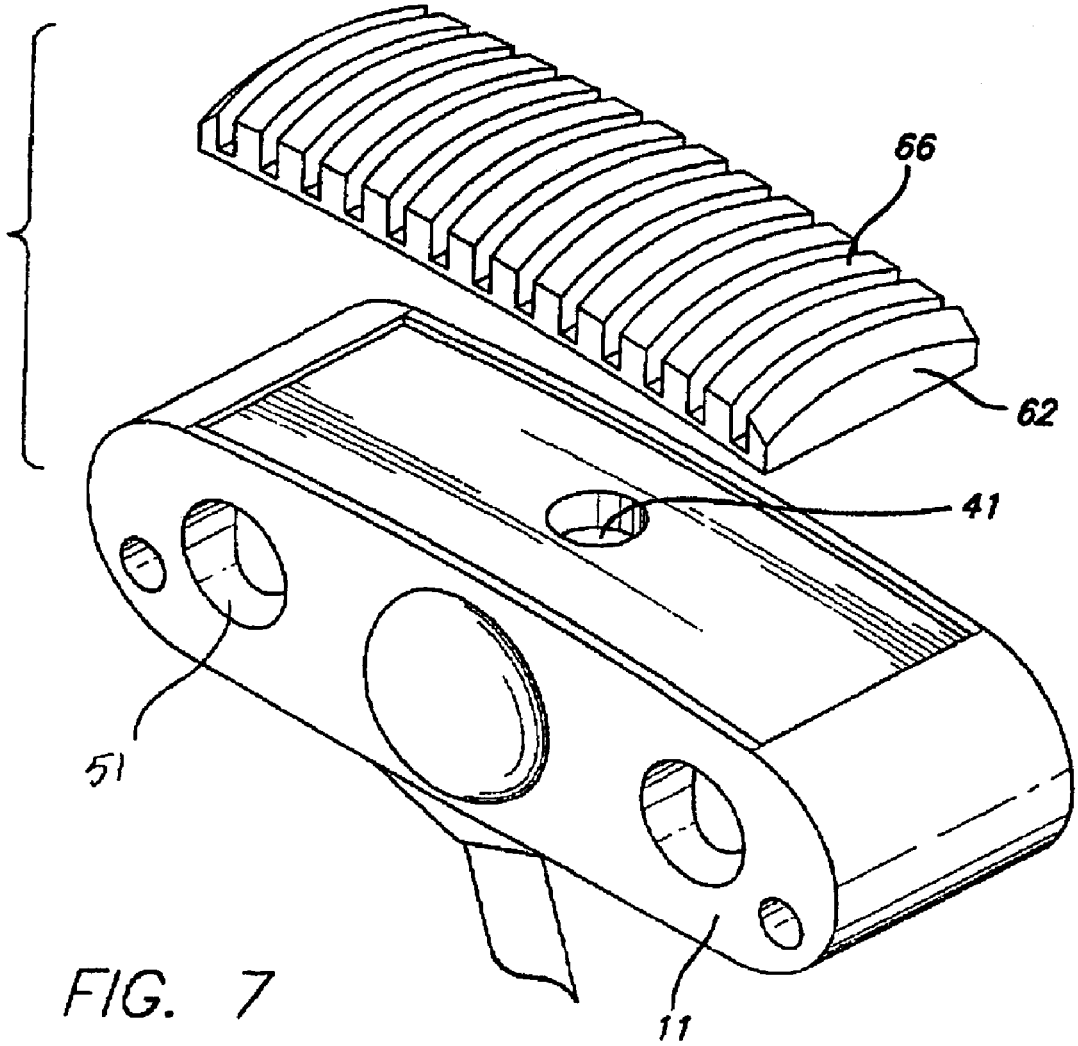
FIG. 7

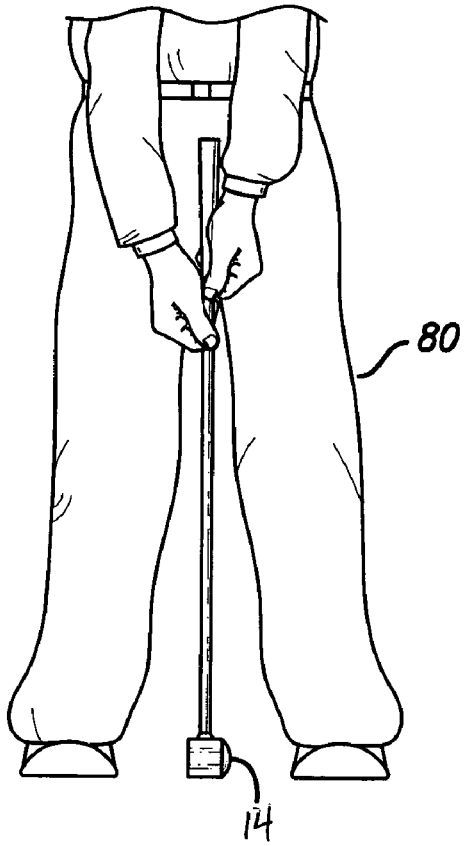
FIG. 8
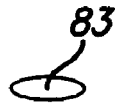
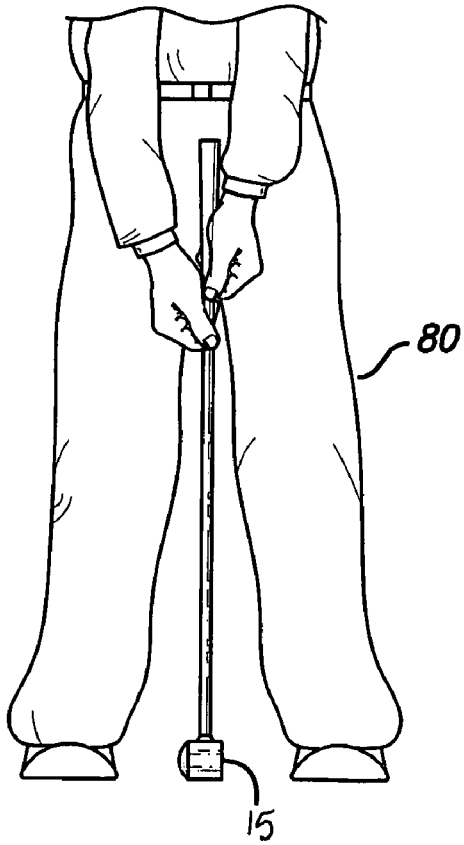
FIG. 9
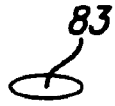

PUTTER WITH FIXABLE SHAFT THAT ROTATES TO CONVERT THE PUTTER FROM PRACTICE TO PLAY

CROSS-REFERENCE TO RELATED APPLICATIONS

This application claims the benefit of and is a continuation-in-part of application Ser. No. 10/920,596 filed Aug. 16, 2004 now U.S. Pat. No. 7,041,004 which is a continuation-in-part of application Ser. No. 10/351,495 filed Jan. 23, 2003, now U.S. Pat. No. 6,776,727. Both of which are hereby incorporated herein by reference.

FIELD OF INVENTION

This invention relates to putters that can be used for practice and play, with either a right or left-handed stroke. Specifically, this invention is a putter rotatable from a first position to strike a golf ball with a practice face of a clubhead to a second position to strike a golf ball with a play face of the clubhead. The putter includes a rotatable hosel and alignment cap that are fixable to the clubhead to form a single unit, in compliance with the USGA Rules of Golf.

BACKGROUND

Golf is governed by The Rules of Golf as approved by the United States Golf Association and the Royal and Ancient Golf Club of St. Andrews, Scotland, referred to herein as the USGA Rules. The most current rules are available from www.USGA.org. A typical game of golf is played on a course having 18 holes and a golfer may carry up to fourteen clubs with him during play. An average golfer uses over 80 strokes to complete the game, and typically half of those stokes are putts. Therefore, the putter is by far the most important of the regulation 14 golf clubs in a golfer's bag, and improved putting will improve a player's score more than improvement in any other stroke.

Consequently, thousands of devices and methods have been devised to help a golfer improve his putting, ranging from the practical to the absurd. Most of these devices do not conform to the design of clubs specified by the USGA Rules, however, and therefore are used during practice only. The golfer must switch putters to play a round of golf, thus changing the primary tool with which he perfected his stroke. As a result, the putt stokes during play are seldom as good as during practice. It would be advantageous, then, to provide a dual-purpose putter that conforms to the USGA Rules so that the golfer can use the same putter in practice as in play.

Under the USGA Rules, the putter shall have a shaft and a head, fixed to form one unit. When the golf club is in its normal position to address the ball, the shaft shall be aligned so that the projection of the straight part of the shaft onto the vertical plane through the toe and heel shall diverge from the vertical by at least 10 degrees. Further, the projection of the straight part of the shaft onto the vertical plane along the intended line of play shall not diverge from the vertical by more than 20 degrees. The USGA Rules further require that the clubhead meet specific criteria. For example, the distance from the heel to the toe of a putter shall be greater than the distance from the play face to the back. These rules limit the orientation of the shaft to the clubhead, and therefore the balance of the putter, a major factor in aligning the ball and in putting consistently.

The penalty for playing a game of golf with a putter that does not conform to the USGA Rules is disqualification from the game. However, with the many rules pertaining to the design of putters, it is difficult to design a club that provides quality training features for practicing and yet can be used for play. It is desirable to provide a single putter that can be converted from a practice putter to a play putter that conforms to USGA Rules.

For putters that are convertible from practice to play, one of the most difficult USGA Rules to comply with relates to "providing a putter with a shaft and a head, fixed to form one unit." The fit between the clubhead and shaft must be extremely tight as to be essentially one unit.

It would also be desirable for a golfer to practice with putters of various weights to determine which weight makes the most accurate puts. Further, as a golfer's stroke changes over time, the golfer may want to change the weight of the putter. While a golfer can buy several putters each of a different weight, multiple putters are expensive and each one has its own characteristics that require the golfer to practice with to become accurate. It would be desirable to have a single putter that allows the golfer to change its weight.

During the putt stroke, the clubhead passes above the solid ground by only a very short distance. The length and density of the grass on each green may vary, causing the friction against the putter to vary accordingly. It would be desirable to have nearly constant friction against the putter on every green, so that a uniform putt stroke could be used from green to green. One way to make the friction as constant as possible is to reduce it as much as possible.

Therefore, it is an object of the present invention to provide a putter with a clubhead that is capable of rotating from a first position to strike the ball with a practice face to a second position to strike the ball with play face in which the shaft and clubhead that are fixed so securely that they form essentially one unit. It is another object of this invention to provide a putter that enables the golfer to change its weight. It is another object to provide a putter in which the friction between the clubhead and grass is minimized. It is also an object of this invention to provide a putter that enables the golfer to determine which strokes are the best during practice so that he may practice those strokes repeatedly and learn to stroke the ball consistently in play. It is another object of this invention to provide a single putter that can be used for both practice and play. It is a further object of this invention to provide a putter in which the shaft always diverges at least 10 degrees from the sole of the clubhead, regardless which orientation the golfer holds the putter when addressing the ball.

SUMMARY OF THE INVENTION

The present invention is a putter with a clubhead that rotates from a first position to strike the ball with a practice face to a second position to strike the ball with a play face. The putter includes a hosel with an attached alignment cap that fits in mated recesses defined by the clubhead so that the shaft and clubhead are fixed as essentially one unit. The clubhead of the present invention also enables one or more weights to be inserted within the clubhead to alter the clubhead's weight. Finally, the putter includes a base plate attached to the bottom of the clubhead to reduce any friction that may be present between the green and the clubhead.

BRIEF DESCRIPTION OF THE DRAWINGS

FIG. 6 shows a cross section take along line 6-6 of FIG. 1.

FIG. 7 illustrates a partially-exploded bottom perspective view of the putter;

FIG. 8 illustrates a golfer practicing a right-handed putt stroke with the practice-face;

FIG. 9 illustrates a golfer playing a right-handed putt stroke with the play face.

DETAILED DESCRIPTION OF THE INVENTION

Figure 1:
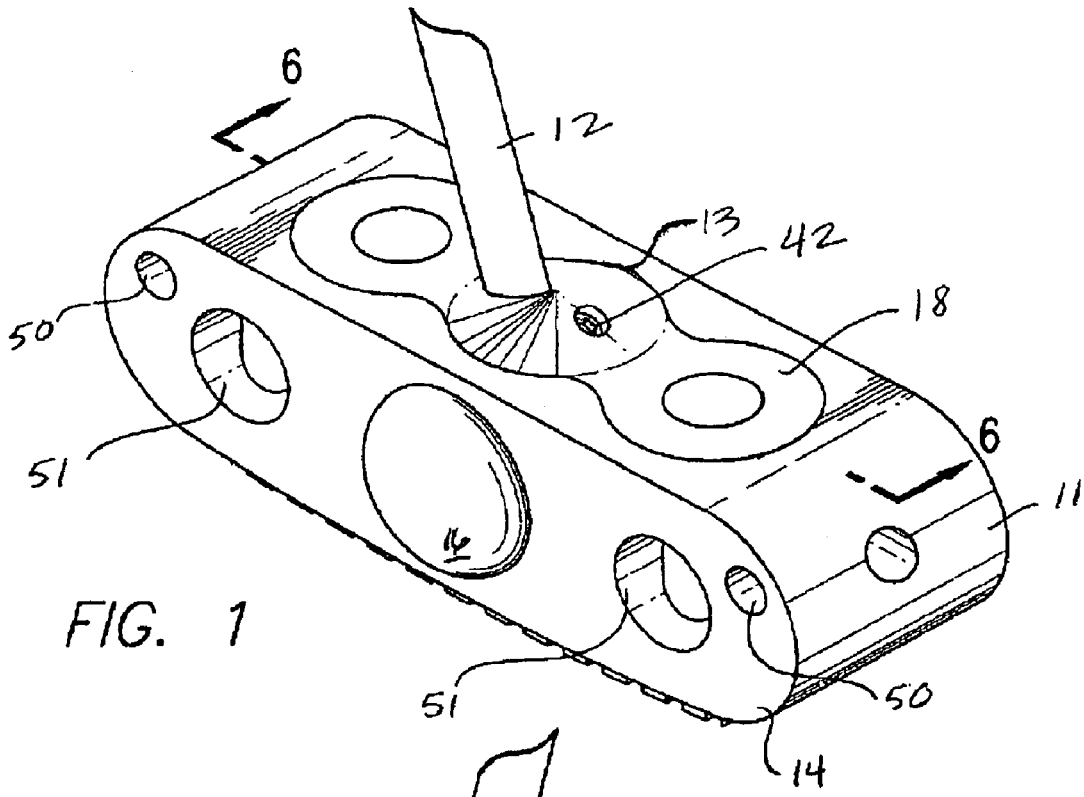
FIG. 1 is a perspective view of the putter showing the practice face.
Figure 2:
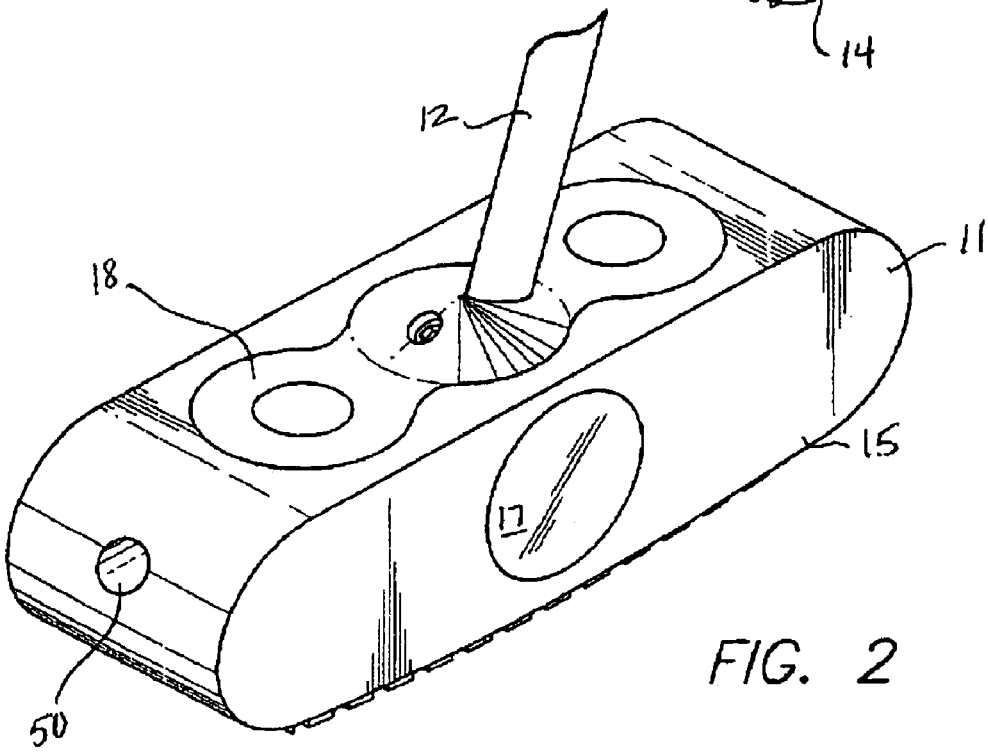
FIG. 2 is a perspective view of the putter showing the play face.

The present invention comprises a putter having a shaft 12 attached to a clubhead 11 with a hosel 13. See FIGS. 1-7. The present device may be used with shafts of any length. The hosel 13 includes an alignment cap 18 that firmly secures clubhead 11 to shaft 12 to form a unit that is not conveniently taken apart. The clubhead 11 has two faces, a practice face 14 and a play face 15. Only the play face is used as a striking surface during play, thereby conforming with a USGA Rule that a clubhead have only one striking face. The shaft is attached to the clubhead in such a way that the clubhead can rotate from a practice position to a play position, keeping the shaft in the same position relative to the golfer. See FIG. 1 which shows the practice face 14 of a clubhead 11 in the play position for a right handed golfer. FIG. 2 shows the play face 15 of the same putter. FIG. 8 shows a right-handed golfer 80 making a putt stroke with the practice face 14 and FIG. 9 shows the same golfer 80 making a putt with a play face 15.

Figure 4:
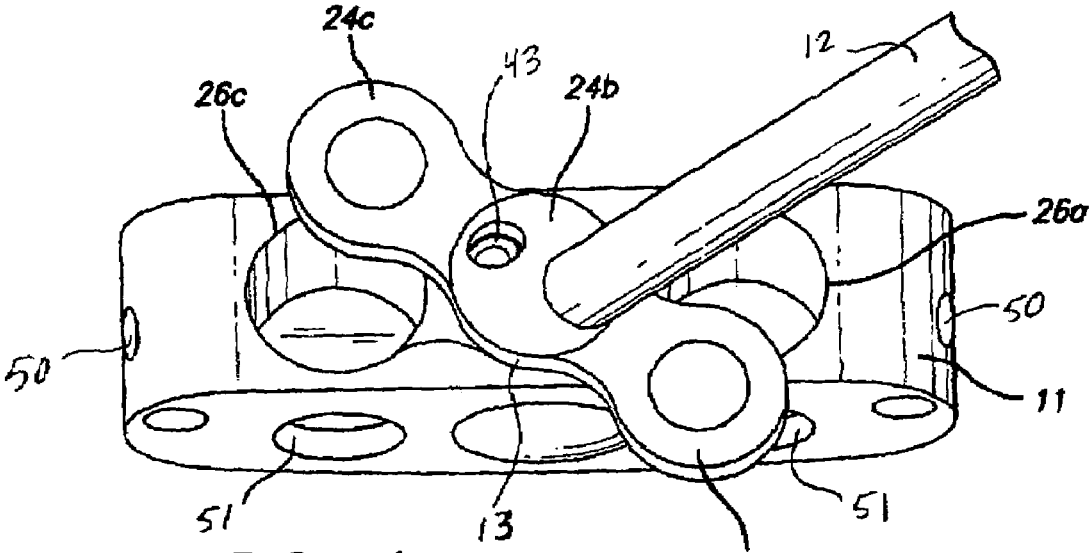
FIG. 4 is a top perspective view of the putter showing the alignment cap rotated out of alignment.
Figure 5A:
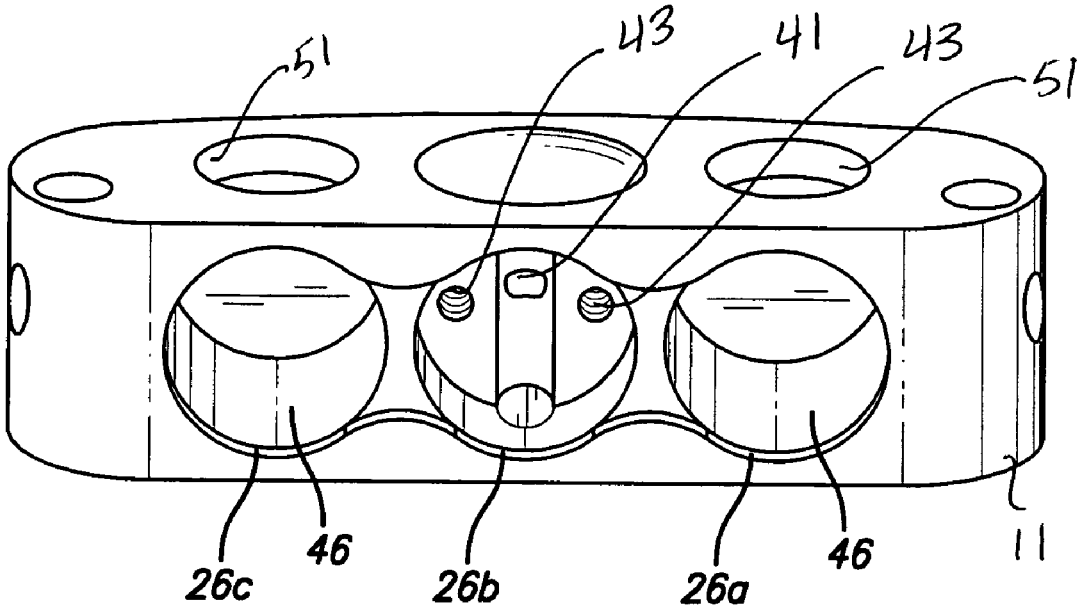
FIG. 5*a* is a top perspective view of the clubhead with the alignment cap, hosel and shaft removed.
Figure 5B:
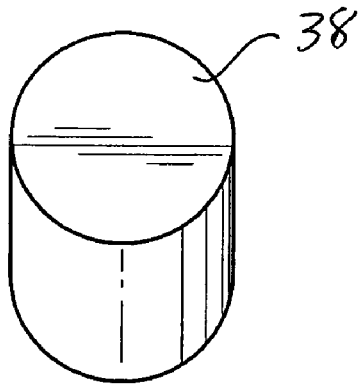
FIG. 5*b* shows a weight.

The shaft 12 is attached to the hosel 13 as shown in FIG. 4. In turn, the hosel 13 is attached to the alignment cap 18, which cooperates with one or more mated structures in the clubhead 11 to align the shaft 12 and the clubhead. As used herein, "attached" means that the parts are integral with each other or are separate components that have been connected to each other. In the preferred embodiment, the alignment cap 18 includes three lobes 24*a*, 24*b*, and 24*c* which engage three mated recesses 26*a*, 26*b*, and 26*c* which are defined by the clubhead 11. See FIG. 4. In this preferred embodiment, the recesses 26 are connected to each other, but non-connected recesses 26 could be used and fall within the scope of the present invention. In alternative embodiments, the number of mated lobes and recesses can be increased or decreased, and the shape of the lobes and recesses can be changed, for example from circular to square, ovoid, triangular or other shape. Additionally, instead of lobes and recesses, pins, pegs or other types of protrusions could be placed on the alignment cap 18 to engage apertures, holes or any other type of recess located on the clubhead 11. Alternatively, the clubhead could have protrusions that mate with apertures in the alignment cap.

When three lobes 24 are used, a center lobe 24*b* is designed to fit within a center recess 26*b* defined by the clubhead 11. See FIGS. 4 and 5*a*. The remaining two side lobes, 24*a* and 24*c* in turn engage corresponding recesses 26*a* and 26*c*. The mated structures ensure that the shaft 12 and the clubhead 11 are aligned and tightly secured to each other.

Several components cooperate to fix the shaft 12 to the clubhead. See FIG. 6. A first attachment structure causes the alignment cap 18 to be rotatably retained to the clubhead 11 and the second attachment structure causes the alignment cap 18 to be fixed securely to the clubhead 11.

In the first attachment structure, a retention screw 40 is aligned through a mated retention aperture 41 that extends through the clubhead 11 and into the alignment cap 18. The retention aperture 41 has smooth sidewalls where it goes through the clubhead 11 but the retention aperture is matedly threaded in the alignment cap 18 to securely receive the retention screw 40. See FIG. 6. As a result, when the retention screw 40 is in place, the alignment cap 18 can be separated from the clubhead 11 distance "A" while still being retained thereto, so that it swivels freely. The retention screw may take the form of a regular screw, a Chicago screw, rivet, detent and socket pair, or other device that allows the alignment cap 18 to be rotatably retained to the clubhead. The distance "A" that the alignment cap 18 can be separated from the clubhead 11 is greater than or equal to the thickness "B" of the alignment cap 18. This facilitates the rotation of the shaft from a practice position to a play position.

In the second attachment structure, a set screw 42 is aligned through one of two mated set apertures 43 that extend through the alignment cap 18 and into the clubhead 11. The clubhead portion of the set aperture 43 is matedly threaded to securely receive the set screw 42. See FIG. 6. The portion of the set aperture 43 in the alignment cap 18 can be smooth-walled or threaded. As a result, when the set screw 42 is in place, the alignment cap 18 cannot be separated from the clubhead 11. This prevents the rotation of the shaft 12 and fixes the shaft 12 and the clubhead 11 together to form essentially one unit. Preferably the set screw 42 is a hex screw or some other screw with a head that would be difficult or time-consuming to remove while on a golf course.

The clubhead 11 is switched from a practice position to a play position by removing set screw 42 so that the shaft 12 may be pulled away from the clubhead 11. Once the hosel 13 and alignment cap 18 are free of their seated position in the clubhead 11, the clubhead 11 is rotated approximately 180 degrees relative to the shaft 12. The hosel 13 is guided to its seated position by placing lobes 24*a*, 24*b*, 24*c* within recesses 26*a*, 26*b*, 26*c* and the play face 15 is now facing the ball. The process is completed by re-inserting and tightening set screw 42 into the other set aperture 43.

In the preferred embodiment, the clubhead 11 has recesses 46 to hold removable weights. See FIGS. 5*a* and 5*b*. The recesses are referred to herein as weight cavities 46. One or more weights 38 may be inserted into each weight cavity 46 to adjust the weight of clubhead 11 to the golfer's liking. See FIG. 5*b*. Preferably the weights 38 fit snugly in the weight cavities 46. A golfer can vary the weight of clubhead 11 by using equally-sized weights 38 made of different materials that have different densities. For example, aluminum weights would cause the club to weigh less than brass weights, which would weigh less than lead weights. Preferably only a single weight 38 is placed within each of the cavities, which complies with USGA Rules, but alternatively several weights 38 can be placed in cavities. Preferably the weight cavities 46 are aligned with the recesses 26 such that the weights are retained within the weight cavity by the alignment cap. Aligning the weight cavities will also make it easier to load the weights and to manufacture the clubhead.

Further, in the preferred embodiment, the clubhead 11 has one or more apertures on the practice face 14 that allow the golfer to see the weight 38 in the weight cavity 46 without having to remove the alignment cap 18. By using weights of different colors, whether painted or simply by the nature of the material used, the golfer can quickly determine which weights are in the clubhead and therefore the weight. These apertures are referred to herein as weight windows 51.

As described in the related applications and patent, the practice face 14 has a substantially circular insert, referred to as a practice insert 16. The practice insert 16 is convex relative to the practice face 14, and the practice face 14 shape ranges from elliptical to spherical. The curved shape limits the number of points at which the practice face 14 can strike a golf ball in order for the golf ball to move in a straight line perpendicular to the practice face 14, referred to as the line of putt. Hitting the center of the golf ball with the center of the practice face 14 will cause the golf ball to move on the perpendicular line. However, if the golfer hits the golf ball with any part of the practice face 14 other than the center of the practice insert 16, the golf ball will veer off the perpendicular line. The farther away from the center of the practice insert 16, the worse the veer angle will be.

Preferably the practice insert 16 is an ellipse. With an elliptically practice insert 16, the veer is relatively small at short radii from its center, thereby being somewhat forgiving to a less-than-perfect stroke. This approximates the amount of forgiveness of putts in play, because slight deviations for a perfect line of putt will not prevent the golf ball from falling in the hole. However, as the veer angle grows increasingly larger farther away from the center of the practice face 14, the "penalty" for a bad stroke increases as the strokes become increasingly off-center. A spherical practice insert may also be used; it provides a less forgiving center, but a more forgiving perimeter, as the veer angle changes relatively less than at the perimeter of an elliptical practice insert. The "penalty" for a bad stroke is constant regardless of how off-center the stroke is. It is likely that a better golfer will use the spherical practice insert to fine tune his putt stroke.

In addition to the curvature of the practice insert 16, the present invention includes a number of alignment apertures 50 for assisting the golfer in visualizing a straight line to the ball or other desired point. Each alignment aperture is made in the clubhead 11 to receive a lightweight post that extends substantially perpendicularly from the practice face 14. A conventional drinking straw is suitable for the post, as is it extremely lightweight and most convenient to obtain at a golf course. Preferably, the diameter of each aperture is made to enable a drinking straw to be inserted and held in place snugly simply by friction. A post can be inserted in any one or more of the alignment apertures, in whichever placement the golfer finds it assists his alignment the best. In the preferred embodiment, the practice face 14 has two alignment apertures, however more are acceptable.

The play face 15 also has a substantially circular insert, referred to as a play insert 17. The play insert 17 is inwardly parabolic relative to the play face 15, ranging from flat to concave. A flat striking face is required under USGA Rules, so a flat play insert should be used when playing a round of golf.

Figure 10:
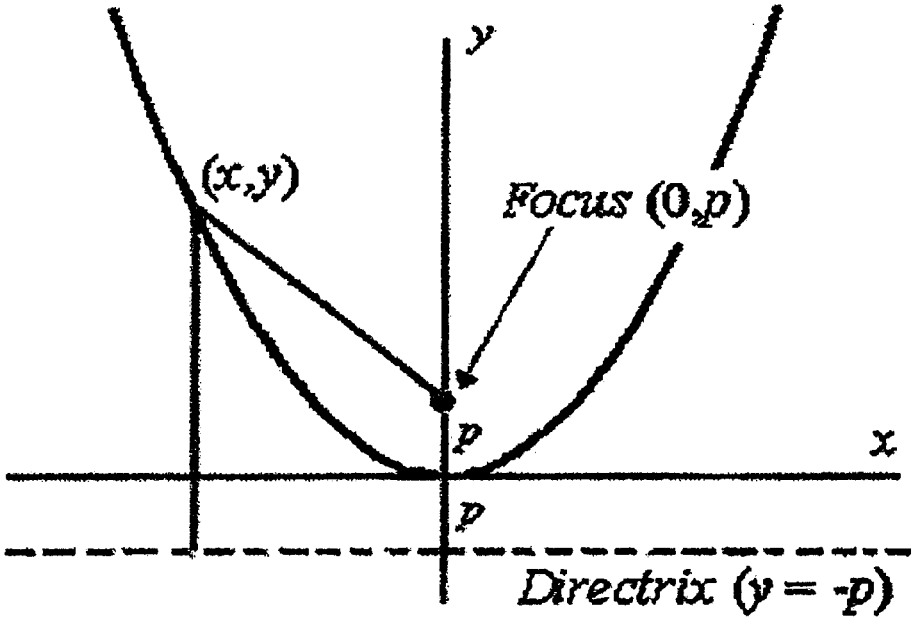
FIG. 10 is a graph of a parabola.

See FIG. 10. A parabolic-shaped play insert is self-correcting to some degree, because the curve of the insert will urge the golf ball to the center of the parabola before redirecting the ball away from the play face. A parabola is the set of all points in a plane equidistant from a fixed point (called the focus) and a fixed line (called the directrix). The formula for a parabola is generally:

$$y = \frac{x^2}{4p}$$

Figure 3:
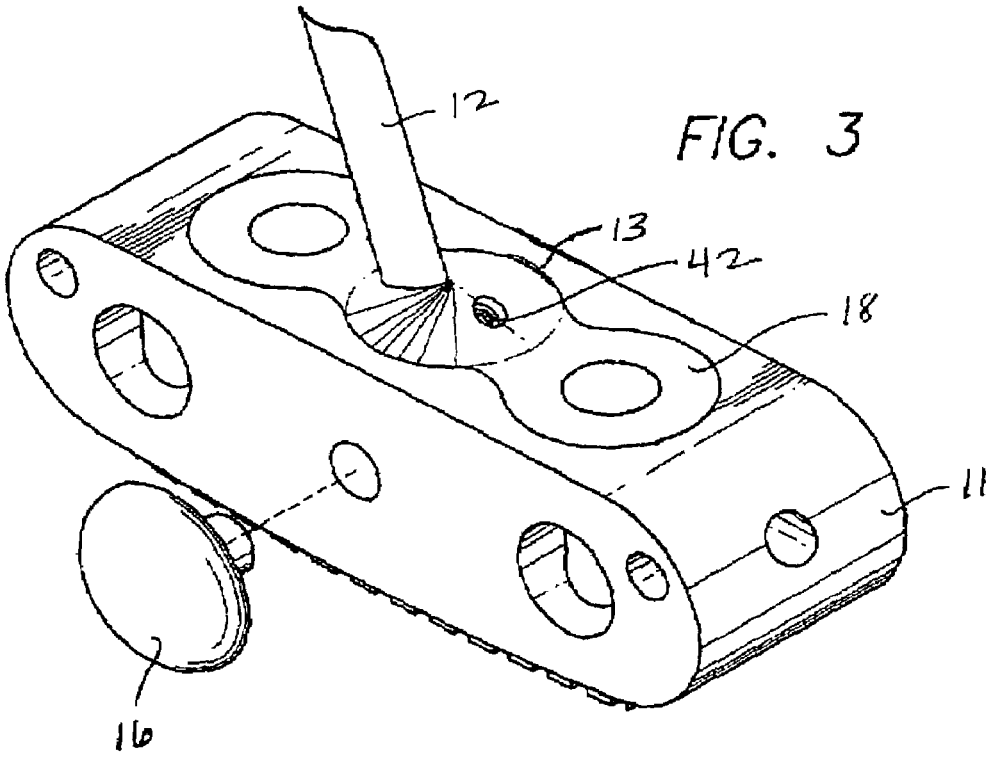
FIG. 3 is an exploded perspective view of the practice face.

Thus, when P is large, the curvature of the play insert 17 is great and the ball is strongly urged to the center of the parabola. As the parabola flattens out, that is, as P becomes small, the play insert 17 provides less assistance in getting the ball to travel on the putt line perpendicular to the play face. When the parabola is flat, that is, when y is constant, the striking face is flat, and the putter 10 provides no self-correcting assistance to the golfer. Preferably, the play insert 17 is flat so that the putter 10 conforms to USGA Rules. FIGS. 1-3 illustrates a preferred embodiment of the clubhead 11 having a curved practice insert 16 and flat play insert 17.

As shown in FIG. 7, the clubhead 11 includes a base plate 62 that is attached to the clubhead 11, preferably by friction fit, although, glue, another adhesive or any other attachment mechanism may suffice. The base plate 62 is preferably has a cross section to minimize the amount of head surface that comes into contact with green. The base plate 62 may be smooth or, preferably, include a series of ridges 66 creating grooves aligned along the line of putt that allow grass to pass through them thereby reducing the amount of friction between clubhead 11 and the ground. The grooves aid in combing the green thus aiding the golfer in holding the head perpendicular to the intended line while the stroke is in the critical phase of moving across the green.

The clubhead is made of any durable material, and preferably metal such as aluminum, brass or steel. The practice insert 16 is also made of a durable material, but preferably a hard composite material such as a polymer that provides for a satisfying "thunk," such as Surlyn® thermoplastic resin sold by the E.I. DuPont DeNemours and Company, which was the first and most durable cover material that revolutionized the construction of the golf ball when it was introduced in the 1980s. The play insert 17 is made of durable materials, metal or composite, and preferably the same material as the practice insert 16 so that the feel of the practice stroke is the same as the stroke during play.

One USGA Rule requires that the projection of the straight part of the shaft 12 onto the vertical plane through the toe and heel shall diverge from the vertical by at least 10 degrees. In other words, the angle between the shaft 12 and the sole of the club must be less than 80 degrees. FIGS. 8 and 9 illustrate a golfer 80 practicing a right-handed putt stroke into hole 83. The golfer uses the practice face 14 to hit the ball and improve his aim. By rotating the putter approximately 180 degrees in his hands, the golfer can use the same putter 10 and the same stance to putt in play. FIG. 9 illustrates the same golfer putting in play, using the play face 15 as the striking face.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A putter comprising a shaft connected to a clubhead wherein the shaft includes an alignment cap that enables the clubhead to be fixed in a first position to strike a golf ball with a practice face and then be rotated to a second position and fixed there to strike a golf ball with a play face.

2. The putter according to claim 1 further comprising a first attachment structure that causes the alignment cap to be rotatably retained to the clubhead such that the clubhead can be rotated approximately 180 degrees relative to the shaft.

3. The putter according to claim 2 wherein the first attachment structure includes a retention screw aligned through a mated retention aperture that extends through the clubhead and into the alignment cap.

4. The putter according to claim 2 further comprising a second attachment structure that causes the alignment cap to be fixed securely to the clubhead.

5. The putter according to claim 4 wherein the second attachment structure includes a set screw aligned through a mated set aperture that extends through the alignment cap and into the clubhead.

6. The putter according to claim 1 in which the alignment cap has one or more lobes, each of which fits into a mated recess defined by the clubhead.

7. The putter according to claim 6 wherein the alignment cap has three substantially circular lobes connected to each other and the clubhead has three substantially circular recesses that mate with the lobes.

8. The putter according to claim 1 in which the clubhead has one or more weight cavities for receiving removable one or more weights.

9. The putter according to claim 8 wherein the alignment cap has three substantially circular lobes connected to each other and the clubhead has three substantially circular recesses that mate with the lobes and the weight cavities are aligned with one or more lobes of the alignment cap.

10. The putter of claim 1 further comprising a base plate having a series of grooves oriented along the line of putt.

11. The putter of claim 1 further comprising one or more alignment apertures.

12. A putter comprising:

a) a shaft;

b) a hosel attached to the shaft;

c) a clubhead that defines one or more recesses; and d) an alignment cap attached to the hosel which engages the recesses.

13. The putter according to claim 12 further comprising:

a) a first attachment structure that causes the alignment cap to be rotatably retained to the clubhead such that the clubhead can be rotated approximately 180 degrees relative to the shaft; and b) a second attachment structure that causes the alignment cap to be fixed securely to the clubhead.

14. The putter of claim 12 further comprising a weight cavity and one or more weights that fit within the weight cavity and are retained within the weight cavity by the alignment cap.

15. The putter according to claim 12 wherein the clubhead further comprises a practice face and a play face opposite each other, wherein the shaft is rotatable from a first position to strike a golf ball with the practice face of the clubhead to a second position to strike a golf ball with the play face of the clubhead.

16. The putter according claim 15 wherein the practice face is convex.

17. The putter according to claim 15 wherein the play face is substantially planar.

18. A putter comprising:

a) a shaft;

b) a clubhead comprising:

i) a top and bottom wherein one or more recesses is defined along the top; and ii) two sides, wherein one side is a practice face and the other side is a play face;

c) a hosel attached to the shaft;

d) an alignment cap attached to the hosel with one or more lobes that engage the recesses;

e) at least one weight that fits within a recess and is secured within the clubhead by the alignment cap; and f) a base plate attached to the bottom of the clubhead;

wherein the clubhead is able to rotate from a first position to strike a golf ball with the practice face to a second position to strike a golf ball with the play face.

19. The putter according to claim 18 wherein the practice face is convex.

20. The puller according to claim 18 wherein the play face is substantially planar.

* * * * *